United States Patent [19]

Marceau

[11] Patent Number: 4,747,173

[45] Date of Patent: May 31, 1988

[54] CONTAINER OPENING TOOL

[76] Inventor: Fernand Marceau, R.R. 1, Box 160, Wheatfield, Ind. 46392

[21] Appl. No.: 37,326

[22] Filed: Apr. 13, 1987

[51] Int. Cl.[4] ..... B67B 7/44

[52] U.S. Cl. ..... 7/156; 81/3.55; 81/3.09

[58] Field of Search ..... 81/3.07, 3.09, 3.55, 81/3.57; 7/151, 152, 156

[56] References Cited

U.S. PATENT DOCUMENTS

| | | | |
|---|---|---|---|
| 1,610,347 | 12/1926 | Wolfe | 81/3.57 |
| 1,656,515 | 1/1928 | Garrison | 7/152 |
| 3,172,317 | 1/1961 | Blakeslee et al. . | |
| 4,216,685 | 8/1980 | Taylor . | |
| 4,234,988 | 11/1980 | Ross et al. . | |
| 4,327,607 | 5/1982 | Morris . | |
| 4,490,132 | 1/1985 | Obey . | |
| 4,580,302 | 4/1986 | Barth . | |

*Primary Examiner*—Roscoe V. Parker
*Attorney, Agent, or Firm*—Richard G. Kinney

[57] ABSTRACT

The tool is used in opening and/or reopening a bulk container of the type having a plastic lid which is mounted to the container by means of an annular rim having a lip that engages an annular rib on the container. The tool comprises an elongate body having a distal end and a proximal end. The proximal end forms a handle for the tool. A base member is mounted on the distal end of the body and a cross-member is mounted on and across the body at a position spaced a predetermined distance from the base member. The cross-member has two oppositely disposed end portions. Each end portion terminates in a hook shaped structure including an arm extending toward the base member. One arm, on a side facing the body, has an arcuate pry-bar configuration. The other arm, on a side facing the body, has a cutting edge.

3 Claims, 2 Drawing Sheets

CONTAINER OPENING TOOL

BACKGROUND OF THE INVENTION

1. Field of the Invention

The present invention relates to a tool for opening a container and more particularly to a combination tool for opening and removing a lid from a large plastic pail-type container or, in the alternative, for re-removing a lid from a previously opened container without recutting of the lid.

2. Description of the Prior Art

Heretofore tools for use in opening and removing a heavy-gauge lid, made of synthetic material and being of the type having a flat top surface and a substantial downwardly extending rim, flange or skirt which ends in a continuous lip, from a container which has an annular rib extending around the exterior surface of the container along the open periphery thereof that locks or latches with the rim have been proposed.

For example, the Taylor U.S. Pat. No. 4,216,685 discloses a complicated container opener having a straight body section and an end portion extension that is almost bent upon itself. The outermost edge of a tip of the extension is inclined at approximately 60° with respect to the plane of the main body section. By means of this formation, the outermost tip of the extension can be inserted between the outer flange of a lid and the outer surface of a pail. By exerting a slight torque on the main body portion, the tip pushes upwardly and outwardly on the flange, to disassociate the flange from the circumferential rib of the pail. The tool is moved around the periphery until a sufficient portion of the lid has been disassociated so as to be easily removed.

Also, the Ross et al. U.S. Pat. No. 4,234,988 discloses a tool for removing plastic lids from pails. The tool includes a handle having a floating knife blade which is adapted to cut into a plastic lid and into slots typically located around the edge rim or flange of such a plastic lid and includes a prying mechanism for bending the slotted edges back from contact with the pail rib in order that the lid may be removed.

Further, the Obey U.S. Pat. No. 4,492,132 discloses a lid removal tool enabling removal of relatively heavy gauge lids from bulk containers where the lid is only removable after a downwardly extending rim or flange thereof is cut at spaced apart points about the circumference. The tool has a rigid shaft with one end adapted for use as a handle and a forked construction at the other end defining two arms configured and arranged to engage about the lid rim. The first arm has at its outer end a portion shaped to rest on the top surface of the lid which is adapted to serve as a fulcrum during lid removal. The second arm has at its end a rim-grouping formation shaped to grip the rim and an upwardly directed cutting edge adapted to move upwardly during inward rotation of the handle in a manner to progressively cut the rim and locally sever the rim, the rim-gripping formation being adapted to engage and pull the rim upwardly during handle rotation.

As will be described in greater detail hereinafter, the tool of the present invention can, first of all, be made and assembled more economically than the tools of the prior art, the tool having no moving parts and being made by stamping of the parts thereof and with the parts being welded together. Also, the tool may be used during the re-opening procedure, such as when the entire content of the pail is not used in the first instance and the lid is again placed on the pail. This re-opening is accomplished without making further cuts around the lid rim and can be utilized as only a prying device or as only a cutting device, the prying and cutting elements being situated at separate locations on the handle.

SUMMARY OF THE INVENTION

In accordance with the present invention a tool is provided for use in opening and/or reopening a bulk container of the type having a plastic lid, which lid is mounted to the container by means of an annular rim having a lip that engages an annular rib on the container. The tool comprises an elongate member having a distal end and a proximal end. The proximal end forms a handle. The distal end of the member has a base member mounted perpendicular thereto. The base member projects outward by a predetermined distance above and below the handle-forming member. A first and a second hook members are provided one projecting above and the other one below the handle. The hook members are a position spaced a predetermined distance from the base member, with the hook members, each having an end portion terminating in a hook shaped structure including an arm extending toward said base member, one arm having an arcuate pry-bar configuration and said other arm having a cutting edge, said hook structures and said base member being so sized and arranged that the base member may be placed on the top of the plastic lid of the bulk container and one on the other hook member hooked under the annular rim of the lid for alternatively prying it upward or slicing it upward by pivoting the handle upward, and the opposite action achieved by inverting the tool and doing the same with it.

DESCRIPTION OF THE PREFERRED EMBODIMENT

Figure 1:
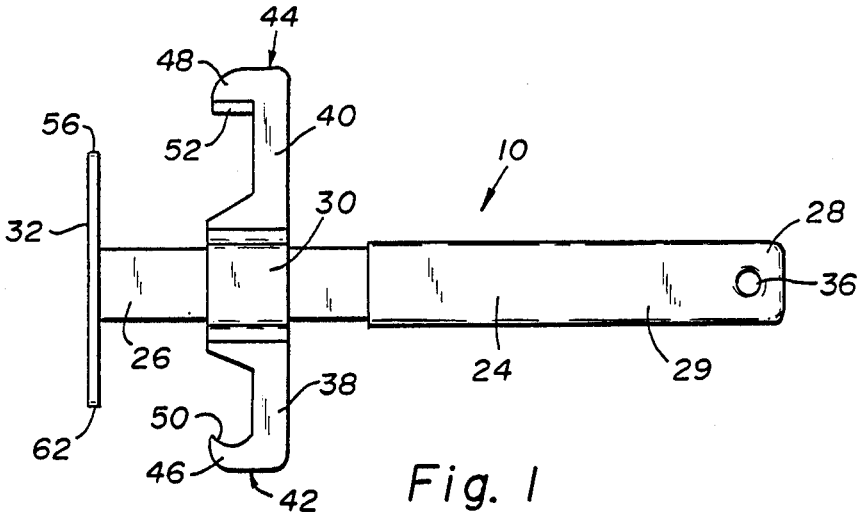
FIG. 1 is a perspective plan view of the tool of the present invention.
Figure 5:
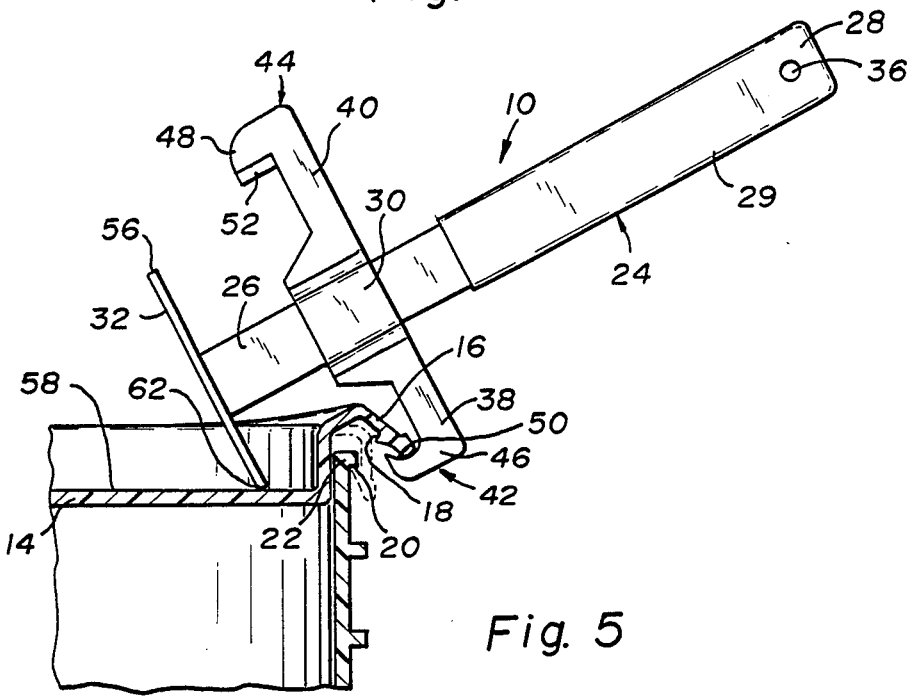
FIG. 5 is a perspective plan view of the tool of the present invention and shows how a rim or downwardly extending flange lip of the lid is pried from its engagement with a circumferential rib of the container by the prying edge of the tool, with the container and lid being illustrated in section.

Referring to the drawings in greater detail, there is illustrated in FIGS. 1 and 5 a combination tool 10 for use in opening and/or reopening a pail-type container 12 which has a lid 14. The lid 14 for this type of container 12 typically includes a downwardly extending flange 16 which ends in a continuous lip 18, with the lip 18 engaging a circumferential rib 20 along a periphery or rim 22 of the pail-type container 12.

As shown, the tool 10 comprises a generally planar, generally rectangular body 24 having a distal end 26 and a proximal end 28. A portion 29 of the body 24 adjacent the proximal end 28 forms a handle portion 29 for the tool 10. The body 24 has mounted thereon a generally planar cross member 30, at a position a predetermined distance from the proximal end 28 of the body 24. Further, at the distal end 26 of the body 24, there is mounted a transversely extending, generally planar, leverage foot or base member 32. The base member 32 is mounted to a extending flange 34 at the distal end 26 of the body 24 extending perpendicular to the body 24. In this way, the body 24 is in a plane perpendicular to the plane of the base member 32.

Further, if desired, the body 24 may be provided at its proximal end 28 with a bore or hole 36, which may be used to mount the tool 10, for example, to a wall above a workbench.

The cross member 30, as illustrated, is provided with two end portions 38 and 40 and an offset middle area 41 which is fixed to the body 24 such that the end portions 38 and 40 lie in substantially the same plane as the body 24. Each end portion 38 and 40 terminates in a hook-shaped structure 42, 44 defined by an arm 46 or 48, respectively, extending from each end portion 38, 40 toward the base member 22. The arm 42, on a side facing the body 24, has an arcuate pry-bar configuration 50 and the arm 44, on a side facing the body 24, has a cutting edge 52, or knife edge 52.

Figure 2:
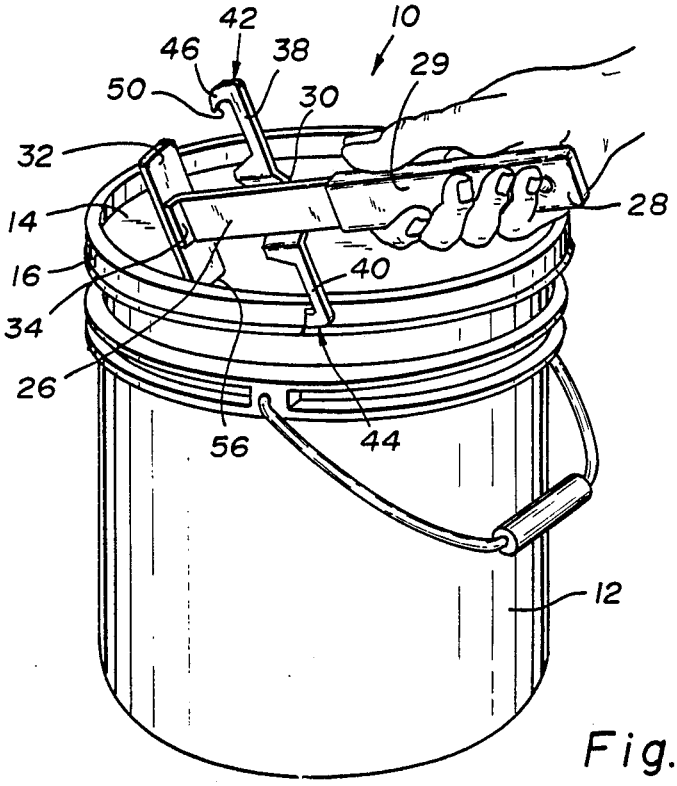
FIG. 2 is a perspective view of the tool of FIG. 1 being utilized to cut the rim of a container lid into sections.

As illustrated in FIG. 2, one utilizes the tool 10 to open the bulk container 12 of the type having the plastic lid 14 which has the downwardly extending flange 16 ending in the inwardly projecting circumferential lip 18 (FIG. 5) which engages the circumferential rib 20 (FIG. 5) at the periphery 22 (FIG. 5) of the container 12. The tool 10 of the present invention is first of all utilized to cut the downwardly extending flange 16 of the lid 14 at several positions around the circumference thereof to divide the flange 16 into sections 54 so that the circumferential tension holding the lip 18 of the flange 16 under and in engagement with the circumferential rib 20 of the container 12 is decreased.

This is accomplished by use of the cutting edge or knife edge 52 thereof as illustrated in FIG. 2.

An end edge 56 of the base member 32 of the tool 10 is placed along a top surface 58 of the lid 14 and the proximal end 28 or handle portion 29 of the body 24, once the cutting edge 52 is positioned below and in engagement with the flange 16 of the lid 14, is rotated upwardly against the base member 32 so as to produce a cut 60 in the flange 16 of the lid 14.

Figure 3:
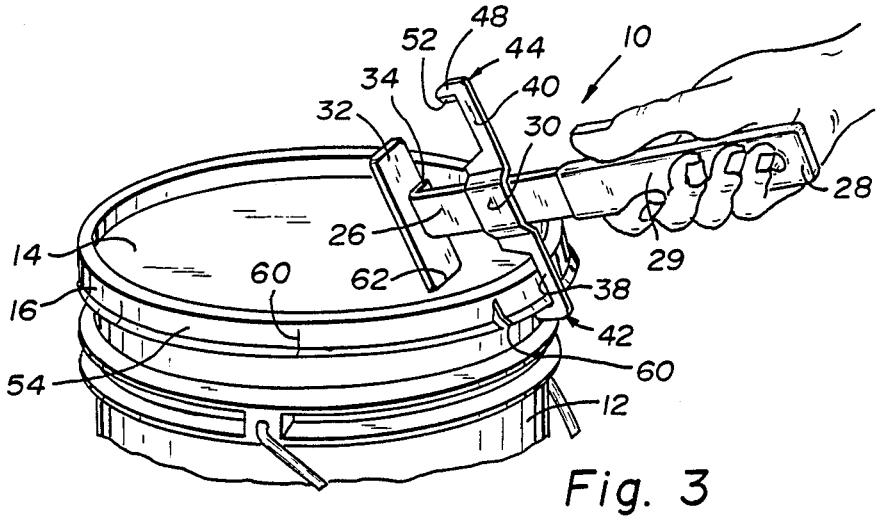
FIG. 3 is a perspective view of the tool of FIG. 1 being utilized to pry one cut section of the container lid rim from engagement with the container on which it is mounted.

Now, turning to FIG. 3, once the flange 16 of the lid 14 has been cut into sections 54 along the peripheral circumference of the lid 14, the tool 10 is turned over in the hand of the user, the arcuate pry-bar configuration 50 on the arm 46 is positioned under the flange 16, preferably at a position between cuts 60, another end edge 62 of the base member 32 is placed upon the top surface 58 of the lid 14, and the user again manipulates the handle portion 29 of the body 24 upwardly, this time disengaging the lip 18 of the flange 16 from engagement with the circumferential rib 20 on the periphery 22 of the container 12.

Figure 4:
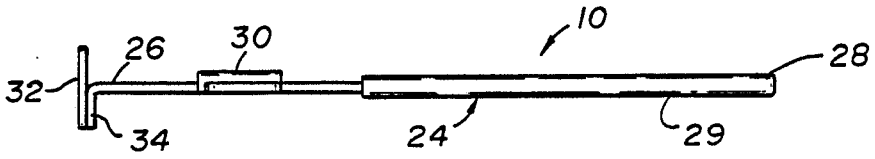
FIG. 4 is a side plan view of the tool of FIG. 1.

Turning now to FIG. 4, there is illustrated therein a side plan view of the tool 10 of the present invention showing that the tool 10 is a compact structure, taking up only a minimum of space. Here it is best seen that the base member 32 of the tool 10 is attached, such as by welding, to the flange 34 provided at the distal end 26 of the tool 10 and shows that the end portions 38 and 40 of the cross member 30, having the cutting element 52 and arcuate pry-bar configuration 50 lie in the same plane as the plane of the body 24, thus providing a tool 10 which has a narrow side dimension.

Turning now to FIG. 5, there is illustrated therein the tool 10 in use in prying the lip 18 of the flange 16 of the lid 14 from engagement with the rib 20 of the container 12. This engagement is illustrated in phantom in FIG. 5, with the container 12 and lid 14 therefor shown in cross section to provide for ease of definition of the utility of the arcuate prybar configuration 50 of the arm 42 of the tool 10.

End edge 62 of the base member 32 of the tool 10 is placed along the top surface 58 of the lid 14, with the pry-bar configuration 50 of the tool 10 being received under and around the flange 16 of the lid 14, and, when the handle portion 29 of the body 24 of the tool 10 is rotated upwardly against the base member 32 of the tool 10 resting on the top surface 58 of the lid 14, the lip 18 of the flange 16 is disengaged from the rib 20 formed on the periphery 22 of the container 12.

Further, because the tool 10 has a cutting edge 52 which is provided as a separate edge from the arcuate pry-bar configuration 50 of the tool 10, the tool 10 may be utilized as shown in FIG. 5 to re-open a container 12 without making further cuts 60 in the flange 16 of the lid 14 as is again best shown in FIG. 5. This allows for repeated openings and closings of the container 12 with the lid 14 still being attachable to the container 12 by lip 18 to rib 20 engagement.

Accordingly, the tool 10 of the present invention provides a simple, compact tool for use in the opening or reopening of a container 12 as described above and is simple and inexpensive to manufacture, the manufacturing process requiring only a stamping process to form the three basic elements, the body 24, the cross member 30, and the base member 32, of the tool 10 and then only requiring a simple welding or other such assembly method to fix the three elements 24, 30 and 32 together.

Further, the tool 10 of the present invention can be modified without departing from the teachings of the present invention. For example, the handle portion 29 may be coated with plastic or rubber for gripping ease. Accordingly, the scope of the invention is only to be limited as necessitated by the accompanying claims.

A prototype tool has been constructed and tested and shown to work well. For purposes of definiteness of disclosure but not for purposes of limitation, the construction of this prototype will be hereafter set out. Of course, the present inventor himself may well vary from the particular set-out construction in the future on the basis of future experience and inspiration. However, the following is his current best thinking on the detailed construction for this tool.

The body 24 is preferably about one inch by 9 inches by 1/16-inch steel sheet stock, with flange 34 being formed by a 90 degree bending an approximate one inch by ½-inch terminal portion and with an approximately 5/16-inch hole centered about ½ inch from the other end. The base 32 is preferably formed from a one inch by 3¼-inch piece of the same steel sheet material. The cross member 30 is preferably about 5½ inch by 1 1/16th inches in overall size and made from the same stock. The hook 50 is formed at about 2 to 2⅛ inches from the centerline of the handle 24, and the blade 52 is formed at about 2½ inches from the centerline of the handle 24. The portions of the cross member 30 are preferably about ½ inch in width at their narrowest. The handle is preferably covered by a layer of rubber or plastic (about 1/32-inch thick) over about 5½ inches from the proximal end 28 by dipping. While the preferred construction would spot weld the three steel members or parts of the invention together, the prototype was constructed with rivets which proved to be more than adequate.

While a particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

I claim:

1. A tool for use in opening and/or reopening a bulk container of the type having a plastic lid which is mounted to the container by means of an annular rim having a lip that engages an annular rib on the container, the tool comprising: an elongate flat member having a distal end and a proximal end, said proximal end forming a handle; a flat base member at the distal end of said elongated member mounted thereto to be in a plane perpendicular to that of said handleforming flat member and to project outward therefrom by a predetermined distance above and below said handle-forming member; and a first and second flat hook structure members projecting one above and one below said handle-forming member at a position spaced a predetermined distance from said handle-forming member, said first and second hook structure members each having an outwardly disposed end portion, each end portion terminating in a hook shaped structure including an arm extending toward said base member, one arm on a side facing said handle-forming member having an arcuate pry-bar configuration and said other arm on a side facing said handle-forming member having a cutting edge, said hook structure members and said base member being so sized and arranged that the base member may be placed on the top of the plastic lid of the bulk container and one hook structure member hooked under the annular rim of the lid for alternatively prying it upward or slicing it upward by pivoting the handle upward, and the opposite action achieved by inverting the tool and doing the same with it.

2. The tool of claim 1 wherein said flat handle member is about 9 inches by about one inch by about 1/16 inch in size, said flat base member is about one inch by 3¼ inches by 1/16 inch in size and projects about equally above and below the handle, and said flat hook structures lie in approximately the same plane as the flat handle member and define hooks about 2⅛ and 2½ inches above and below the centerline of the said handle member.

3. A tool for use in opening and/or reopening a bulk container of the type having a plastic lid which is mounted to the container by means of an annular rim having a lip that engages an annular rib on the container, the tool comprising: an elongate member having a distal end and a proximal end, said proximal end forming a handle; a base member at the distal end of said elongated member mounted thereto to be perpendicular to said elongated member and to project outward therefrom by a predetermined distance above and below said elongated member; and a first and second hook structure members projecting one above and one below said elongated member at a position spaced a predetermined distance from said base member, said first and second hook structure members each having an outwardly disposed end portion, each end portion terminating in a hook shaped structure including an arm extending toward said base member, one arm on a side facing said elongated member having an arcuate pry-bar configuration and said other arm on a side facing said elongated member having a cutting edge, said hook structure members and said base member being so sized and arranged that the base member may be placed on the top of the plastic lid of the bulk container and one hook structure member hooked under the annular rim of the lid for alternatively prying it upward or slicing it upward by pivoting the handle upward, and the opposite action achieved by inverting the tool and doing the same with it.

* * * * *

UNITED STATES PATENT OFFICE

CERTIFICATE OF CORRECTION

Patent No. 4,747,173 Dated May 31, 1988

Inventor(s) Fernand Marceau

It is certified that error appears in the above-identified patent and that said Letters Patent are hereby corrected as shown below:

On The Title Page:

On the front sheet under "References Cited U.S. PATENT DOCUMENTS", delete "4,490,132" and substitute--4,492,132-

Column 1 - Line 54: delete "rim-grouping" and substitute --rim-gripping--.

Signed and Sealed this

First Day of November, 1988

*Attest:*

*Attesting Officer*

DONALD J. QUIGG

*Commissioner of Patents and Trademarks*